US011311097B2

(12) United States Patent
Soverall

(10) Patent No.: US 11,311,097 B2
(45) Date of Patent: Apr. 26, 2022

(54) OIL DISPENSING HAIR BRUSH

(71) Applicant: Tamiko Soverall, Richmond, TX (US)

(72) Inventor: Tamiko Soverall, Richmond, TX (US)

( * ) Notice: Subject to any disclaimer, the term of this patent is extended or adjusted under 35 U.S.C. 154(b) by 215 days.

(21) Appl. No.: 16/436,766

(22) Filed: Jun. 10, 2019

(65) Prior Publication Data

US 2020/0077779 A1 Mar. 12, 2020

Related U.S. Application Data

(60) Provisional application No. 62/682,208, filed on Jun. 8, 2018.

(51) Int. Cl.
*A46B 11/00* (2006.01)

(52) U.S. Cl.
CPC ..... *A46B 11/0013* (2013.01); *A46B 11/001* (2013.01); *A46B 11/0006* (2013.01); *A46B 2200/102* (2013.01); *A46B 2200/104* (2013.01)

(58) Field of Classification Search
CPC ..... A46B 11/0006; A46B 11/001; A46B 11/0013; A46B 11/0062; A46B 11/0086; A46B 2200/102; A46B 2200/104
See application file for complete search history.

(56) References Cited

U.S. PATENT DOCUMENTS

| | | | | |
|---|---|---|---|---|
| 2,558,555 | A | 5/1964 | Birch et al. | |
| 4,557,619 | A | 12/1985 | DeVincentis | |
| 4,692,047 | A | 9/1987 | Endo | |
| D309,529 | S | 7/1990 | Kim | |
| 5,443,321 | A * | 8/1995 | Dolan | A01K 13/002 132/112 |
| 5,927,290 | A | 7/1999 | Endo | |
| 6,022,163 | A | 2/2000 | Asfur | |
| 6,213,129 | B1 | 4/2001 | Muldoon | |
| 6,257,246 | B1 | 7/2001 | Kan | |
| 6,672,313 | B2 | 1/2004 | Battaglia | |
| 9,247,805 | B1 * | 2/2016 | Malm | A46B 11/0079 |
| 9,486,062 | B1 * | 11/2016 | Piatetsky | A46B 9/023 |
| 2003/0221699 | A1 | 12/2003 | Battaglia et al. | |
| 2005/0133055 | A1 * | 6/2005 | Stankovic | A46B 11/0062 132/116 |
| 2007/0144549 | A1 * | 6/2007 | Enriquez | A45D 24/28 132/116 |
| 2008/0041416 | A1 * | 2/2008 | Mathews | A46B 11/0055 134/6 |
| 2014/0060562 | A1 | 3/2014 | Diona | |
| 2015/0272313 | A1 * | 10/2015 | Alsalameh | A46B 9/023 401/28 |
| 2018/0153295 | A1 * | 6/2018 | Pilevsky | A46B 11/00 |

OTHER PUBLICATIONS

ESPACENET, Bibliographic data, Jan. 19, 2018,1, Espacenet.

* cited by examiner

*Primary Examiner* — Ryan A Reis
(74) *Attorney, Agent, or Firm* — Delphine James

(57) ABSTRACT

This invention discloses a liquid dispensing hair brush for dispensing hair oil from a plurality of holes disposed on the top plate of the brush portion. The device further includes a handle portion with an elongated cavity that houses one or more oil chambers. Each oil chamber has a front end that is operationally coupled to a valve mechanism that controls the flow of oil into the brush head. The brush portion can be removably attached to the front end wall of the of the handle portion. Additionally, each oil chamber can contain different oil.

5 Claims, 4 Drawing Sheets

OIL DISPENSING HAIR BRUSH

This application claims the benefit of provisional application No. 62/682,208

BACKGROUND

The present invention relates to liquid dispensing brushes and more particularly pertains to a new liquid hair brush for dispensing oil onto the hair strands and scalp.

The use of liquid dispensing brushes is known in the prior art. More specifically, liquid dispensing brushes heretofore devised and utilized are known to consist basically of familiar, expected, and obvious structural configurations, notwithstanding the myriad of designs encompassed by the crowded prior art which have been developed for the fulfillment of countless objectives and requirements.

Known prior art liquid dispensing brushes included U.S. Pat. Nos. 4,938,621; 4,543,913; 4,875,792; 4,277,193 and 3,964,501. In these respects, the oil dispensing hair brush according to the present invention substantially departs from the conventional concepts and designs of the prior art, and in so doing provides an apparatus primarily developed for the purpose of dispensing liquid onto the scalp and hair strands.

While these devices fulfill their respective specific objectives and requirements the aforementioned patents do not disclose a hair brush that can mix, massage and dispense different oils onto the scalp and the hair strands.

SUMMARY OF THE INVENTION

In view of the foregoing disadvantages inherent in the known types of liquid dispensing brushes now present in the prior art, the present invention provides a new oil dispensing hair brush construction.

To attain this, the present invention generally comprises a handle portion having an elongated cavity formed therein for receiving one or more separate or integrally formed oil chambers therein. The handle portion is attachable to the brush portion that includes a reservoir in fluid communication with the front end of the one or more oil chambers. The brush portion further comprises a top plate having a plurality of spaced hollow bristle members and small drip apertures. Thus, as the brush is stroked through the strands of hair oil is dripped from the reservoir through the apertures onto the hair and scalp. A massage mechanism is utilized to oscillate the hair bristles onto the scalp.

The general purpose of the present invention, which will be described subsequently in greater detail, is to provide a new oil dispensing hair brush apparatus and method which has many of the advantages of the oil dispensing brushes mentioned heretofore and many novel features that result in a new oil dispensing hair brush which is not anticipated, rendered obvious, suggested, or even implied by any of the prior art liquid dispensing brushes, either alone or in any combination thereof.

BRIEF DESCRIPTION OF DRAWINGS

These and other details of the present invention will be described in connection with the accompany drawings, which are not furnished only by way of illustration and not in limitation of the invention.

DETAILED DESCRIPTION OF THE INVENTION

Hereinafter, an embodiment of the present invention will be described in detail with reference to the accompanying drawings. However, the present invention is not limited to the embodiment to be described below but may be implemented in various different embodiments of the hair brush. The embodiment is merely provided to completely disclose the present invention and completely inform those skilled in the art of the spirit of the present invention.

Figure 1:
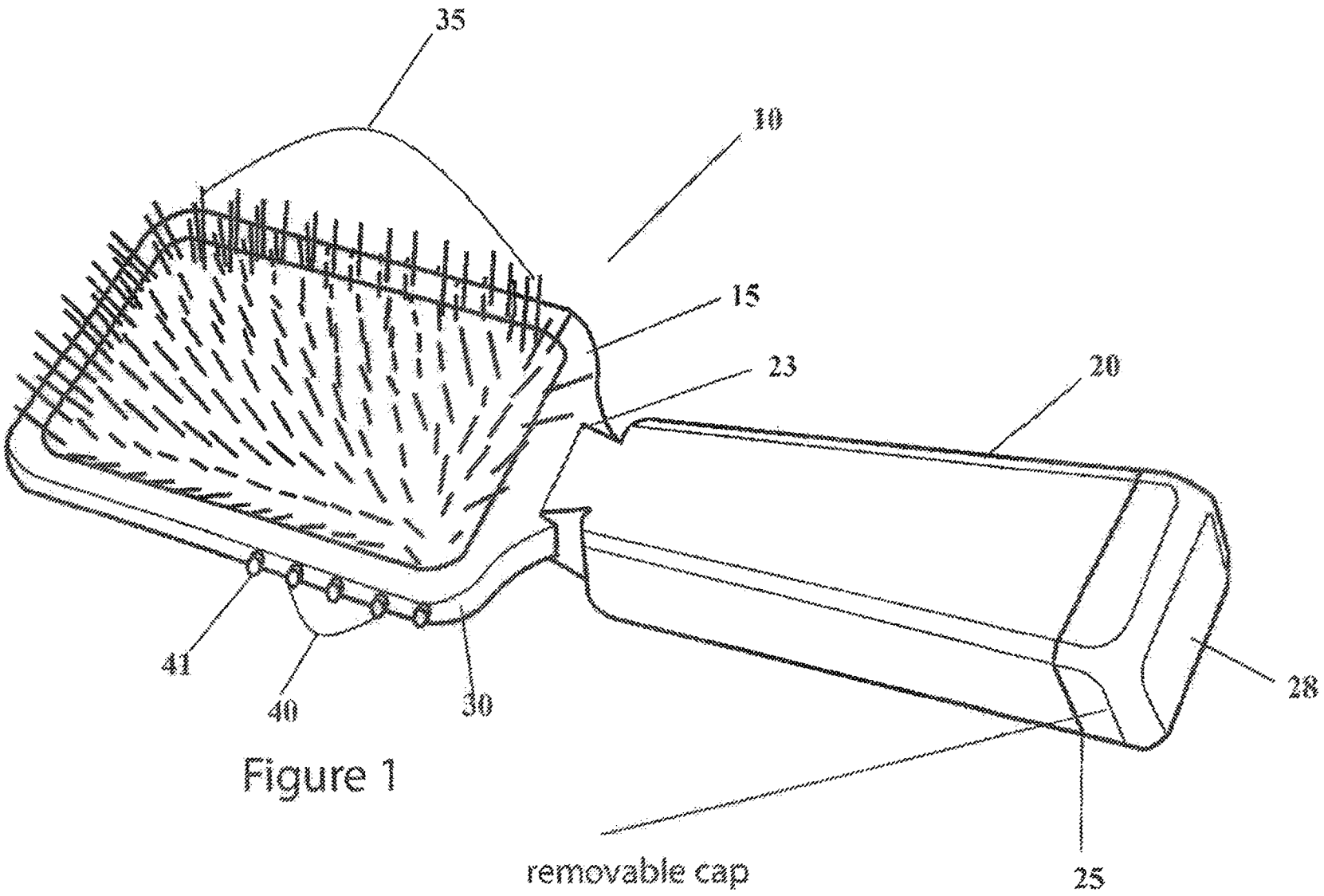
FIG. 1 is a front perspective view showing the hair brush design of the removable cap for oils.
Figure 2:
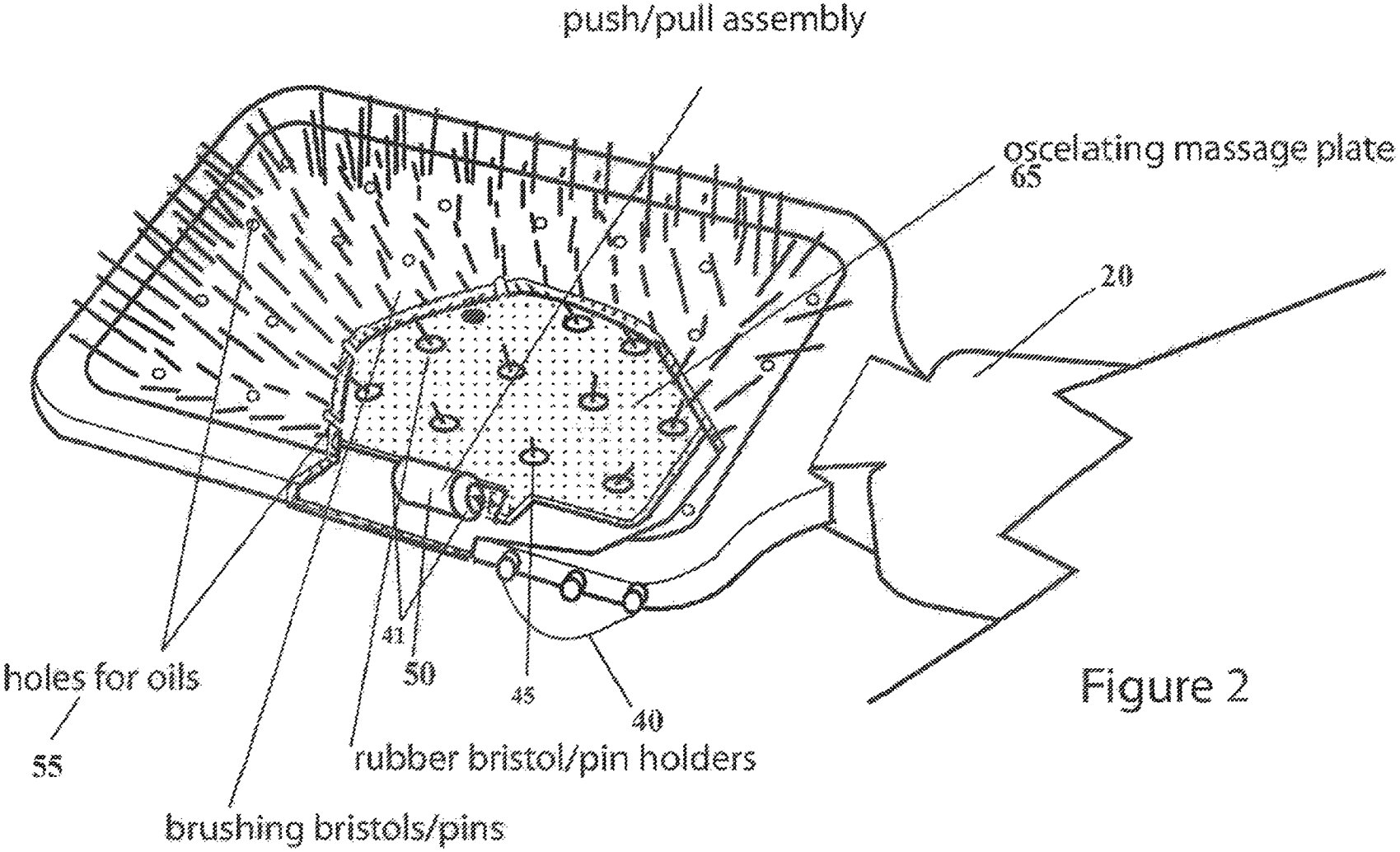
FIG. 2 is a cross sectional side view showing the hair brush design according to an embodiment of the present invention.
Figure 3:
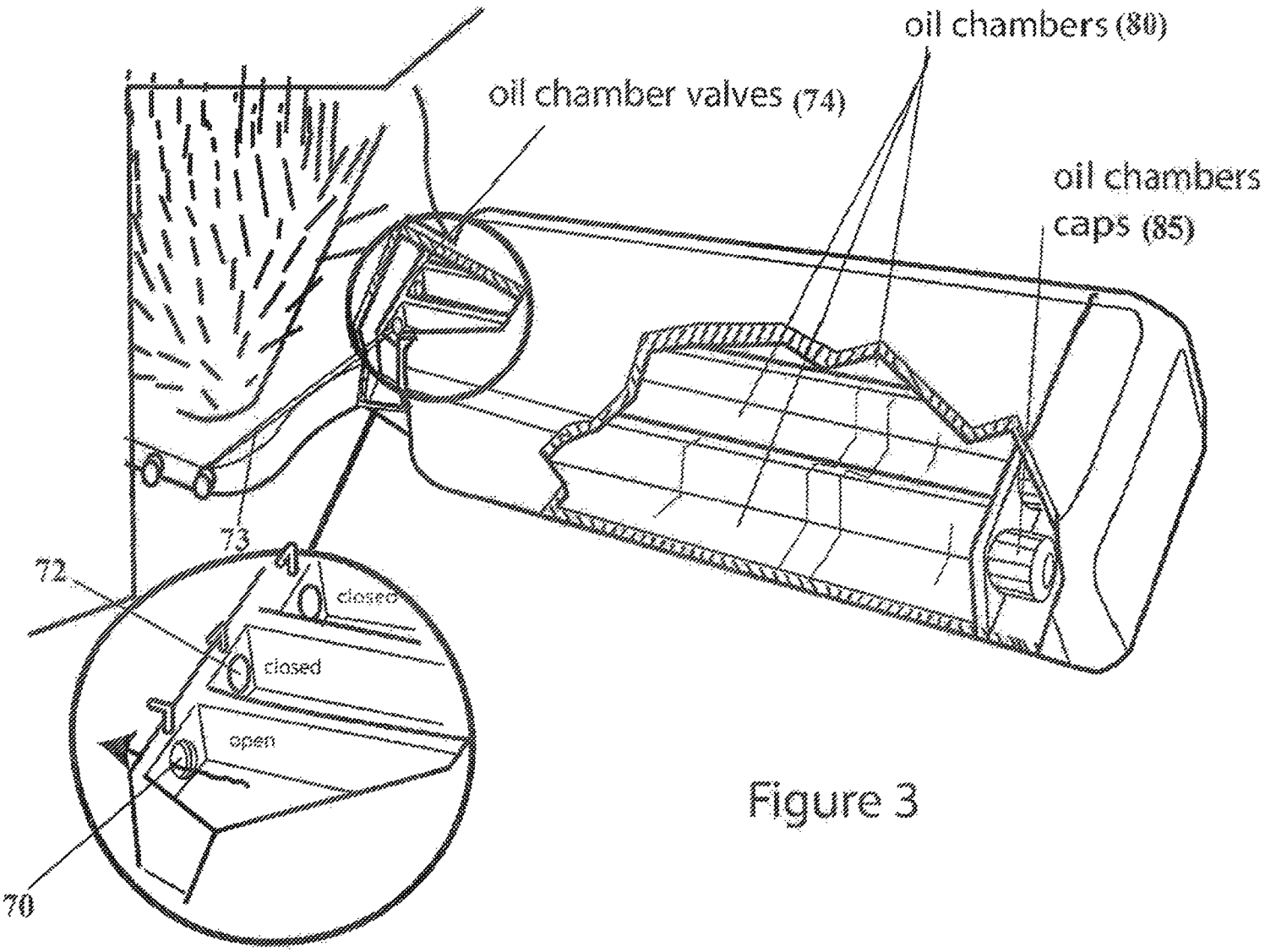
FIG. 3 is a cross sectional exploded view of the hair brush.

With reference now to the drawings, and in particular to FIGS. 1 through 3 thereof, a new oil dispensing hair brush embodying the principles and concepts of the present invention and generally designated by the reference numeral (10) will be described.

Figure 4:
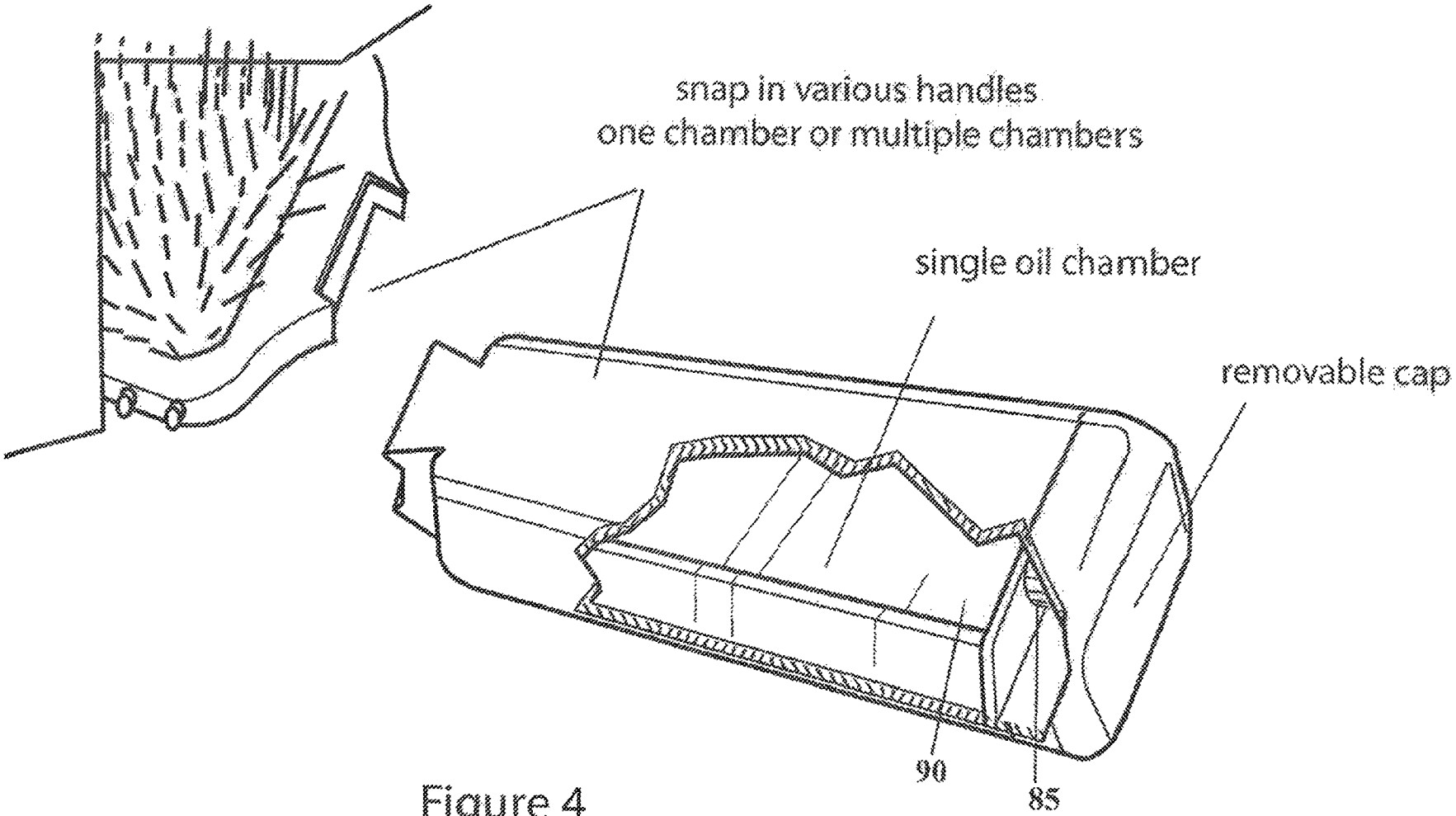
FIG. 4 is a front perspective view of the handle separated from the brush portion.

More specifically, referring to FIGS. 1, 3 and 4, it will be noted that the oil dispensing hair brush comprises a handle portion (20) that is attached to brush head (15). Handle portion (20) that houses an elongated cavity that houses one or more oil chambers (80). Each oil chamber (80) can be a separate container as depicted in FIG. 4 or can be integrally formed within the elongated cavity as depicted in FIG. 3. As depicted in FIG. 3 each oil chamber extends the length of the cavity and has a separate oil cap (85) to secure the oil within the chamber. Handle (20) further comprises a front end (23) and a rear end (25) that is secured by removable cap member (28).

As depicted in FIG. 3 the front end of the handle has one or more corresponding valve mechanisms (74) that are operationally coupled (73) to each corresponding oil chamber (80). In the preferred embodiment each button (40) is connected to a separate valve thereby controlling the fluid flow into the oil pan located within the brush portion (15) of the present invention (10). When button (40) is activated the corresponding valve mechanism is mechanically opened and when button (40) is released the valve mechanism automatically closes thereby ceasing the fluid flow into the oil pan. The multiple button configuration allow the user of the brush to control the combination of mixing different oils in various amounts. In alternative embodiments the valve activation can be controlled electronically.

Brush portion (15) is attachable to the handle portion (20) and has a reservoir (21) in fluid communication with the elongated cavity 18 within the handle. Brush portion (15) is defined by a top wall disposed above a bottom wall that defines a compartment to support reservoir (21). The brush portion 20 further includes a plurality of spaced apart hollow bristle members 30 and apertures (45) thereon. As depicted each bristle member has a straight end aligned next to a small aperture which allows the oils to be massage into the scalp and extend upon the strands of the hair. The apertures (45) are small to provide a drip pan effect onto the scalp and the strands of hair as the user strokes the brush onto hair.

Brush portion (15) further comprises massage plate (65) located underneath the top wall of brush portion (15) above the reservoir. Button (41) is operationally connected to massage oscillating device (50) that causes the plate to move back/forth when pushed. Alternatively, the oscillating device (50) can be implemented electronically.

While the devices fulfill their respective, specific objectives and requirements, the aforementioned patents do not disclose a hairbrush that can mix and dispense different oils.

What is claimed is:

1. An oil dispensing hair brush comprising:

a handle portion that is attached to a brush head;

the handle portion having an internal elongated cavity extending the length of the handle portion;

the brush head comprising a plurality of apertures in fluid communication with a compartment, the brush head comprising a top plate and a bottom plate wherein the compartment is formed therebetween;

the top plate having the plurality of apertures extending therethrough;

a plurality of solid non-hollow bristles protruding upward from the top plate;

the internal cavity is segment into one or more oil chambers; and an oscillating plate disposed below the top plate.

2. The oil dispensing hair brush of claim 1 wherein each of the one or more oil chambers can be a separate container.

3. The oil dispensing hair brush of claim 1 wherein each of the one or more oil chambers can be integrally formed within the internal elongated cavity.

4. The oil dispensing hair brush of claim 1 further comprising an actuator operationally incorporated within the brush head and operationally associated with the oscillating plate.

5. The oil dispensing hair brush of claim 1 further comprising a valve operationally incorporated into the upper end of the handle thereby controlling fluid communication into the compartment.

* * * * *